US008018420B2

(12) United States Patent
Lee et al.

(10) Patent No.: US 8,018,420 B2
(45) Date of Patent: Sep. 13, 2011

(54) LIQUID CRYSTAL DISPLAY DEVICE

(75) Inventors: Seok Woo Lee, Seoul (KR); Dong Il Chung, Kyongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 823 days.

(21) Appl. No.: 11/172,501

(22) Filed: Jun. 29, 2005

(65) Prior Publication Data

US 2006/0038765 A1 Feb. 23, 2006

(30) Foreign Application Priority Data

Aug. 19, 2004 (KR) ..... 10-2004-0065414

(51) Int. Cl.
*G09G 3/36* (2006.01)

(52) U.S. Cl. ..... 345/100; 345/96

(58) Field of Classification Search ..... 345/87, 345/204, 98–100
See application file for complete search history.

(56) References Cited

U.S. PATENT DOCUMENTS

| | | | | | |
|---|---|---|---|---|---|
| 4,481,511 | A * | 11/1984 | Hanmura et al. | ..... | 345/100 |
| 4,724,433 | A * | 2/1988 | Inoue et al. | ..... | 345/208 |
| 5,006,840 | A * | 4/1991 | Hamada et al. | ..... | 345/88 |
| 5,805,128 | A * | 9/1998 | Kim et al. | ..... | 345/96 |
| 5,900,853 | A * | 5/1999 | Shimizu et al. | ..... | 345/98 |
| 6,380,919 | B1 * | 4/2002 | Koyama et al. | ..... | 345/92 |
| 2005/0083279 | A1 * | 4/2005 | Lee et al. | ..... | 345/87 |

* cited by examiner

*Primary Examiner* — Stephen Sherman
(74) *Attorney, Agent, or Firm* — Brinks Hofer Gilson & Lione

(57) ABSTRACT

A liquid crystal display device has facing substrates, pairs of data lines, gate lines intersecting the data lines to define pixel areas, pixel electrodes formed in the pixel areas, a gate driver, a source driver and a latch circuit. Each pair of data lines includes first and second data lines adjacent each other. The gate driver applies a gate signal to the gate lines, and the source driver outputs data signals to the first and second data lines. The latch circuit stores a data signal output from the source driver and transmits relevant data signals to odd and even pixel electrodes formed between the first and second data lines. During high-speed operation, the data signal from the source driver is bisected and applied as an odd and even data signal to two neighboring data lines at certain time intervals.

23 Claims, 10 Drawing Sheets

LIQUID CRYSTAL DISPLAY DEVICE

This application claims the benefit of Korean Patent Application No. P2004-65414, filed on Aug. 19, 2004, which is hereby incorporated by reference in its entirety.

TECHNICAL FIELD

The invention relates to a liquid crystal display device, and more particularly, to a liquid crystal display device with a stabilized display.

RELATED ART

Flat panel display devices such as liquid crystal displays (LCDs), plasma display panels (PDPs), electro-luminescent displays (ELDs), vacuum fluorescent displays (VFDs), etc. are frequently used as a display device. In particular, LCDs have replaced cathode ray tubes (CRTs) for use with mobile image display devices due to advantages such as superior picture quality, compact and lightweight structure, and low power consumption. Further, LCDs are used as TV monitors to receive and display broadcast signals and computer monitors such as laptop computers monitors.

An LCD device includes a liquid crystal panel for displaying an image and a drive circuit for applying drive signals to the liquid crystal panel. The liquid crystal panel includes a first and second glass substrates bonded to each other so as to have a certain space therebetween. A liquid crystal layer is injected between the first and second glass substrates.

The first glass substrate, which is also a thin film transistor (TFT) array substrate, includes a plurality of gate lines, a plurality of data lines, a plurality of pixel electrodes and a plurality of TFTs. Gate lines are arranged in one direction at certain regular intervals, and data lines are arranged in one direction perpendicular to the gate lines at certain regular intervals. Pixel electrodes are formed in a matrix pattern in pixel areas defined by the gate lines and the data lines. The TFTs are switched according to signals from the gate lines for transmitting signals from the data lines to the pixel electrodes.

In the second glass substrate, which is a color filter substrate, a light shield layer is formed to block incidence of light to a region other than the pixel areas. The second glass substrate includes R, G and B color filter layers for reproducing color tones and a common electrode for reproducing an image.

The LCD device operates based on optical anisotropy and polarization of liquid crystal. Since the liquid crystal has a thin and elongated molecular structure, the liquid crystal molecules have an orientation in a certain direction. It is possible to control the orientation of liquid crystal molecules by applying an electric field to the liquid crystal molecules.

The arrangement of liquid crystal molecules is controlled to change, so that the liquid crystal molecules exhibit optical anisotropy. Since light incident to the liquid crystal is refracted in the direction in which the liquid crystal molecules are oriented, image information is represented.

Currently, active matrix LCDs are often used because of superior moving picture reproduction. The active matrix LCDs include TFTs and pixel electrodes connected to the TFTs which are arranged in a matrix array.

Referring to FIG. 1, a display mode of display devices is explained. FIG. 1 is a schematic diagram showing an impulse-type operation mode, and FIG. 2 is a schematic diagram showing a sampling and holding operation mode.

In the impulse-type operation mode of FIG. 1, an image signal is applied in the form of a pulse for every frame at a desired time. This mode is employed commonly in a cathode ray tube such as a Braun tube, where fluorescent material installed in each pixel emits light each time an image signal is applied thereto. In this impulse-type operation mode, since the image signals are not overlapped in every pixel of each frame, a motion blurring phenomenon leaving an afterimage in the eyeplane seldom occurs when displaying a moving image.

In the sampling and holding operation mode of FIG. 2, a brightness of each pixel is held for a certain period of time (frame period or longer) to display an image. When viewed from a desired eyeplane, the motion blurring phenomenon occurs. As a result, an afterimage of the moving image during the previous frame remains, due to overlapping of signal holding periods between neighboring gate lines.

For example, when an image, which is displayed in the above sampling and holding mode, is replaced with another image between two successive frame periods, an image signal corresponding to the next frame is applied to the concerned pixel under the condition that the image signal of the previous frame is not adequately discharged. As a result, a smooth data response with respect to each frame may not be provided.

The sampling and holding mode causing the motion blurring phenomenon is employed in a liquid crystal display device. The inherent viscosity and elasticity of the liquid crystal may result in a lower response speed and a certain period of holding time may need to be secured.

FIG. 3 is a diagram showing a data application for each frame and a backlight operation in LCD devices. FIG. 4 is a diagram showing a data application for each frame and a backlight operation according to a backlight blinking mode.

As shown in FIG. 3, in the LCD device, when a data is applied each frame, the backlight continually remains on. Because each pixel has an extended sampling and holding time, severe motion blurring occurs. The intensity of motion blurring increases in proportion to the length of holding time in the sampling and holding operation mode.

To alleviate this motion blurring, a backlight blinking mode may be used. In FIG. 4, in the backlight blinking mode, the backlight is turned on for a certain period of a frame and turned off for the remaining period of the frame. Thus, the holding time for each frame may be shortened due to the backlight off-time. The motion blurring phenomenon may be reduced. However, the backlight off-time results in decrease in brightness. Further, because the backlight lamp alternates on/off at a high speed, the service life of the backlight lamp may be shortened.

The intensity of the motion blurring is related to the length of holding time. FIGS. 5A and 5B are diagrams showing signal overlap between gate lines. FIG. 5A illustrates an operation mode having a long holding time and FIG. 5B illustrates an operation mode having a short holding time.

As shown in FIG. 5A, the overlap period between neighboring lines is long, and a severe motion blurring occurs at the eyeplane. As shown in FIG. 5B, the overlap period between neighboring lines is relatively short, and the motion blurring at the eyeplane may be reduced.

FIG. 6 is a graph showing a sampling and holding time when operating a liquid crystal display device at 60 Hz in the operation mode having a long holding time. FIG. 7 is a graph showing a sampling and holding time when operating a liquid crystal display device at 120 Hz in the operation mode having a relatively short holding time.

When the LCD device operates at 60 Hz, one frame has a frame period of 16.67 ms (=1/60 (sec)). The sampling and holding is carried out for 16.67 ms per frame. A liquid crystal panel having an XGA (1 024×768) resolution has 768 gate lines. In this case, the application time of a gate high voltage to each gate line (turn-on time of one line of TFT) corresponds to 21.7 μs (=16.67 ms/768).

The operation mode of FIG. 7 has an operation speed twice as much as that of FIG. 6. In this mode, the LCD device operates at 120 Hz and one frame has a frame period of 8.3 ms (=1/120 (sec)). The sampling and holding is carried out for 8.3 ms per frame. In this high-speed operation of an XGA panel, the application time of a gate high voltage $v_{gh}$ to each gate line (turn-on time of one line of TFT) corresponds to 10.8 μs (=8.33 ms/768).

In the above high-speed operation, the sampling and holding time within one frame is very short, i.e., about half (½) time relative to a general operation mode. An adequate holding time may not be achieved. Because the voltage application time to each pixel electrode is cut in half, the data voltage to be applied is not adequately charged on the pixel electrode. As a result, brightness and image quality may be degraded.

FIG. 8 is a graph showing a gate voltage and a charging voltage when the TFT is on. Each gate line is provided with a TFT for each individual pixel. As shown in FIG. 8, when a gate high voltage Vg is applied to a gate line, the TFT associated with the gate line is turned on. A data voltage V1 applied to the relevant data line is filled to a pixel electrode connected to the thin film transistor. In this case, if the turn-on time is adequately secured, a voltage close to the data voltage V1 may be charged on the pixel electrode by means of the gate high voltage of the gate line. In the high-speed operation, an adequate turn-on time may not be obtained, and a voltage V2 lower than the original data voltage V1 may be charged on the associated pixel electrode.

Therefore, the LCD device of related art has several problems as follows. The LCD device has a lower response speed, as compared with other display devices, due to the inherent viscosity and elasticity of liquid crystal. During operation at a certain speed, a signal may be overlapped between two successive frames, thereby causing motion blurring.

To avoid this motion blurring, a backlight blinking method and a high-speed driving method are used. However, the backlight blinking method causes degradation in brightness and reduction in the service life of a backlight lamp, and the high-speed driving method may not obtain an adequate charging time. As a result, brightness may decrease and image quality may degrade. Accordingly, there is a need of an LCD device that substantially overcomes drawbacks of the related art.

SUMMARY OF THE INVENTION

By way of introduction only, in one embodiment, a liquid crystal display device comprises first and second substrates facing each other, a plurality of pairs of data lines, a plurality of gate lines, a plurality of pixel electrodes, a source driver, a gate driver and a latch circuit. The plurality of pairs of data lines are formed in a display section of the first substrate. Each of the pairs of data lines includes first and second data lines adjacent each other. The plurality of gate lines is formed on the first substrate so as to perpendicularly intersect the data lines. The gate lines define pixel areas between the first and second lines. The plurality of pixel electrodes is formed in each pixel area. The gate driver applies a gate signal to the gate lines and the source driver outputs data signals corresponding to the first and second data lines. The latch circuit stores a data signal output from a corresponding one of a plurality of output terminals of the source driver. The latch circuit also transmits relevant data signals to an odd pixel electrode and an even pixel electrode formed between the first and second data lines.

In other embodiment, a liquid crystal display device further comprises a plurality of first thin film transistors each formed at an intersection of the first data line and a corresponding odd one of the gate lines and electrically connected to a corresponding one of the pixel electrodes; a plurality of second thin film transistors each formed at an intersection of the second data line and a corresponding even one of the gate lines and electrically connected to a corresponding one of the pixel electrodes. The LCD device also comprise a first sampling/holding unit and a second sampling/holding unit each for storing a data signal operable to output from a corresponding one of a plurality of output terminals of the source driver.

In an LCD device, during a high-speed operation, a data signal from the source driver is bisected and then applied as an odd data signal and an even data signal to two neighboring data lines at certain time intervals. As a result, a charging time for the data signal may be secured and the data signal may be displayed in a stable manner.

BRIEF DESCRIPTION OF THE DRAWINGS

The accompanying drawings, which are included to provide a further understanding of the invention and are incorporated in and constitute a part of this application, illustrate embodiment(s) and together with the description serve to explain the principle of the invention. In the drawings.

DETAILED DESCRIPTION OF PREFERRED EMBODIMENTS

Reference will now be made in detail to the preferred embodiments, examples of which are illustrated in the accompanying drawings. Wherever possible, the same reference numbers will be used throughout the drawings to refer to the same or like parts.

Figure 1:
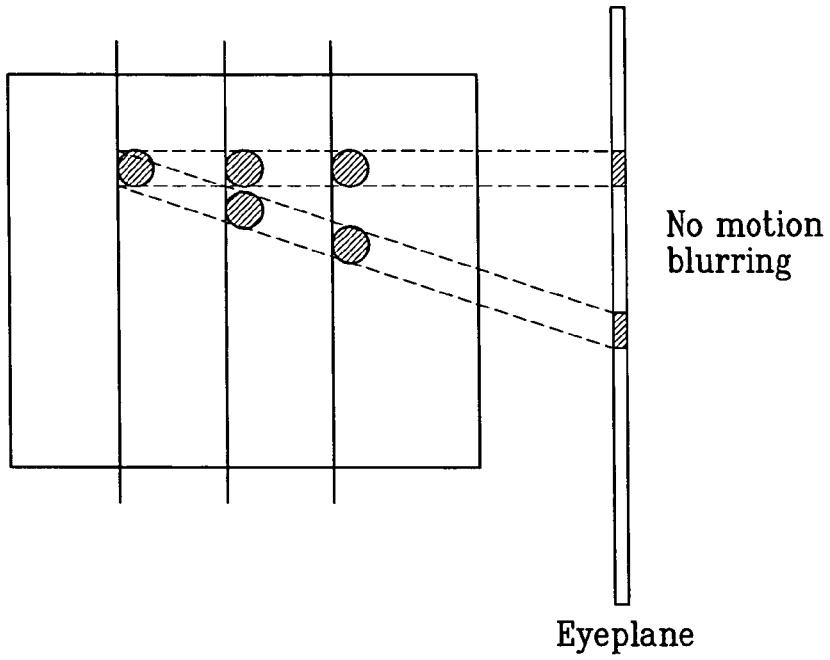
FIG. 1 Related Art
FIG. 1 is a schematic diagram showing an impulse-type operation mode.
Figure 2:
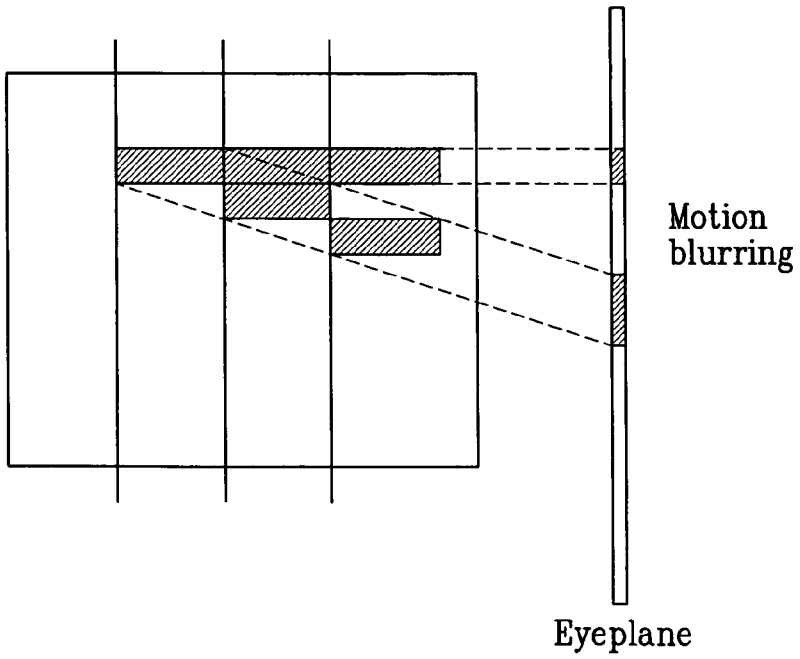
FIG. 2 Related Art
FIG. 2 is a schematic diagram showing a sampling and holding operation mode.
Figure 3:
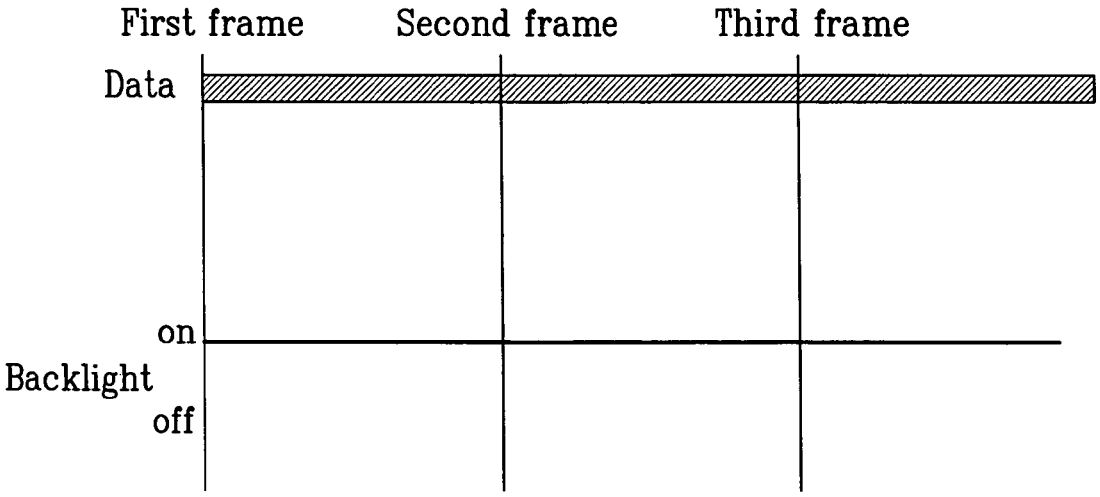
FIG. 3 Related Art
FIG. 3 is a diagram showing a data application for each frame and a backlight operation in LCD devices of the related art.
Figure 4:
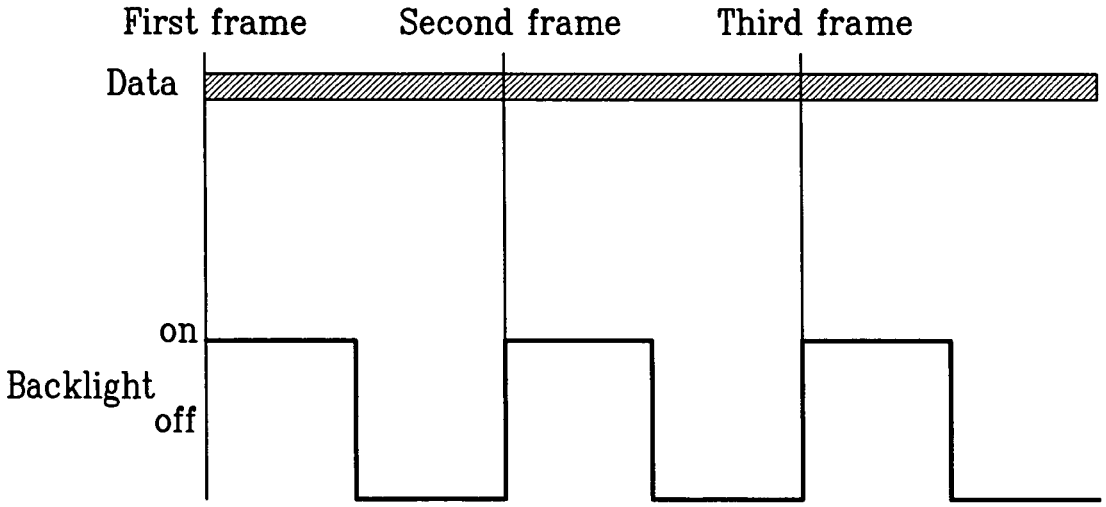
FIG. 4 Related Art
FIG. 4 is a diagram showing a backlight operation according to a backlight blinking mode of the related art.
Figure 5A:
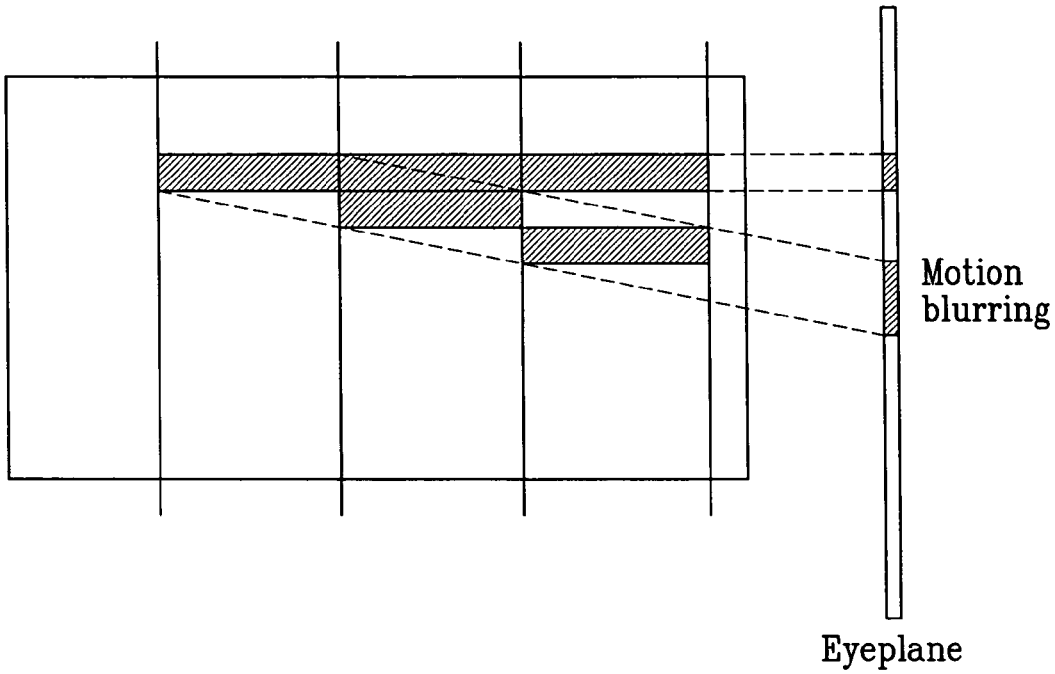
FIG. 5A Related Art
FIGS. 5A and 5B are diagrams showing signal overlap between gate lines in operation modes having a long holding time and a short holding time.
Figure 5B:
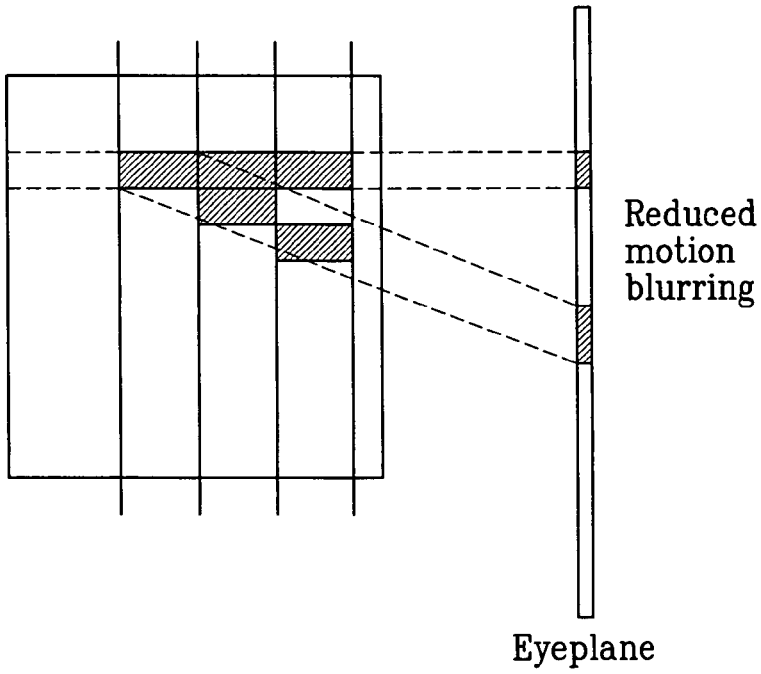
FIG. 5B Related Art
Figure 6:
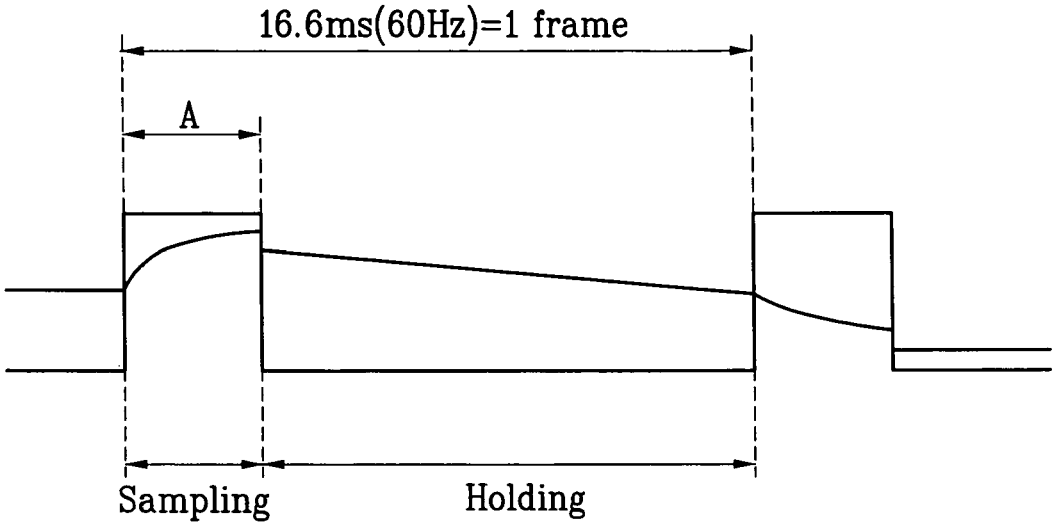
FIG. 6 Related Art
FIG. 6 is a graph showing a sampling and holding time when operating a liquid crystal display device at 60 Hz in the related art.
Figure 7:
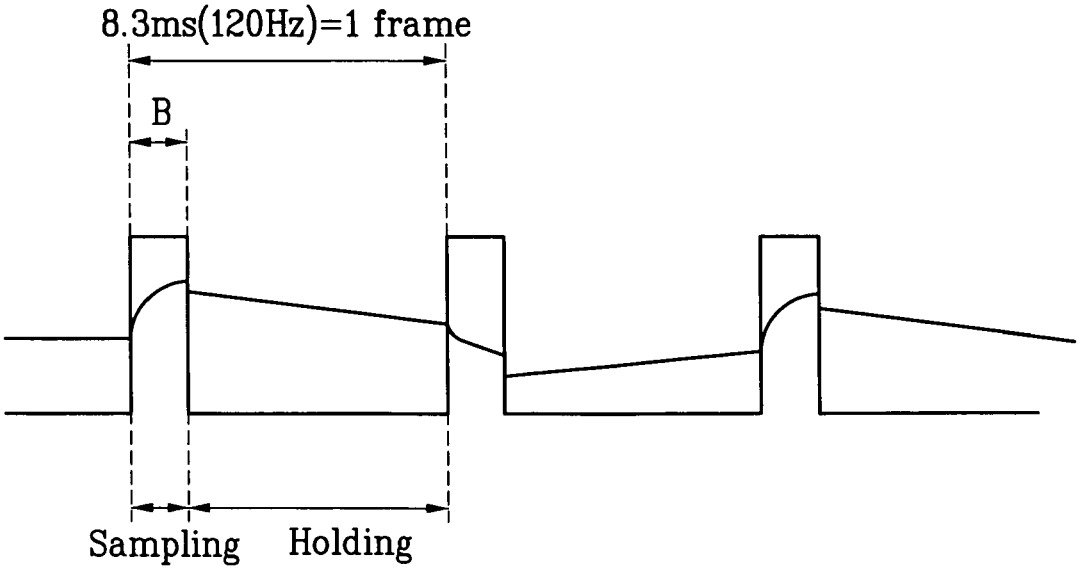
FIG. 7 Related Art
FIG. 7 is a graph showing a sampling and holding time when operating a liquid crystal display device at 120 Hz in the related art.
Figure 8:
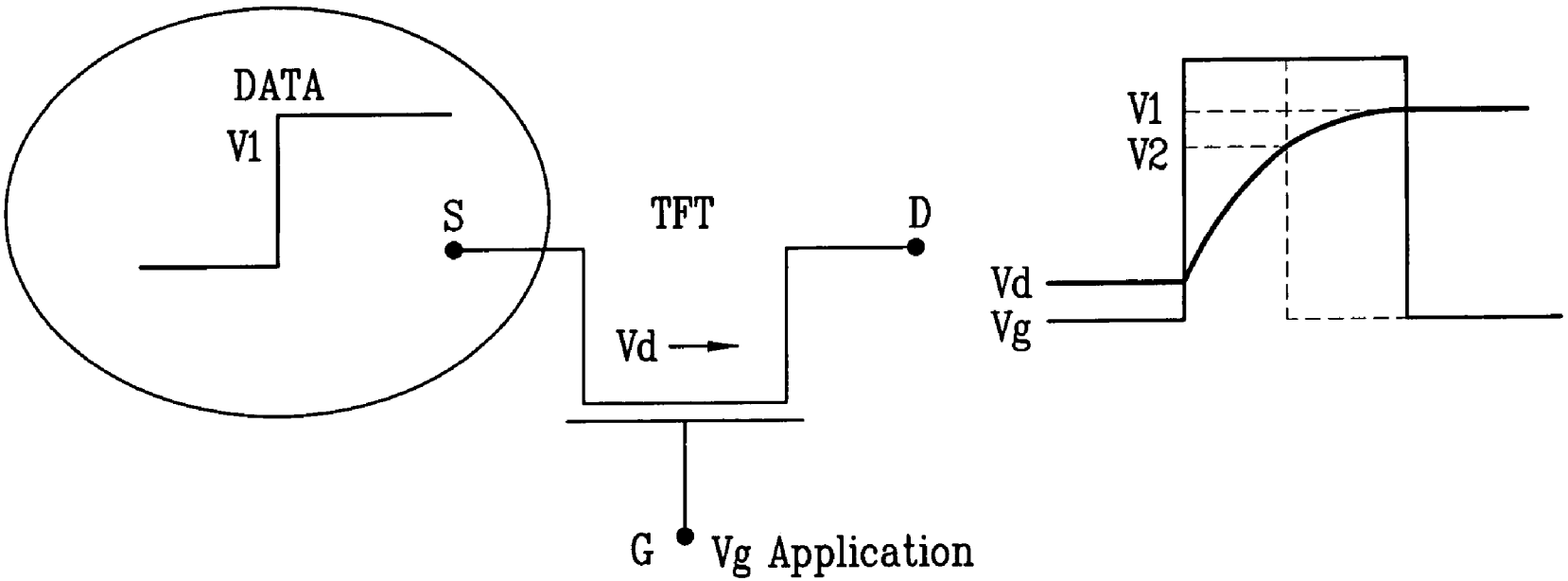
FIG. 8 Related Art
FIG. 8 is a graph showing a gate voltage and a charging voltage when a thin film transistor is on in the related art.
Figure 9:
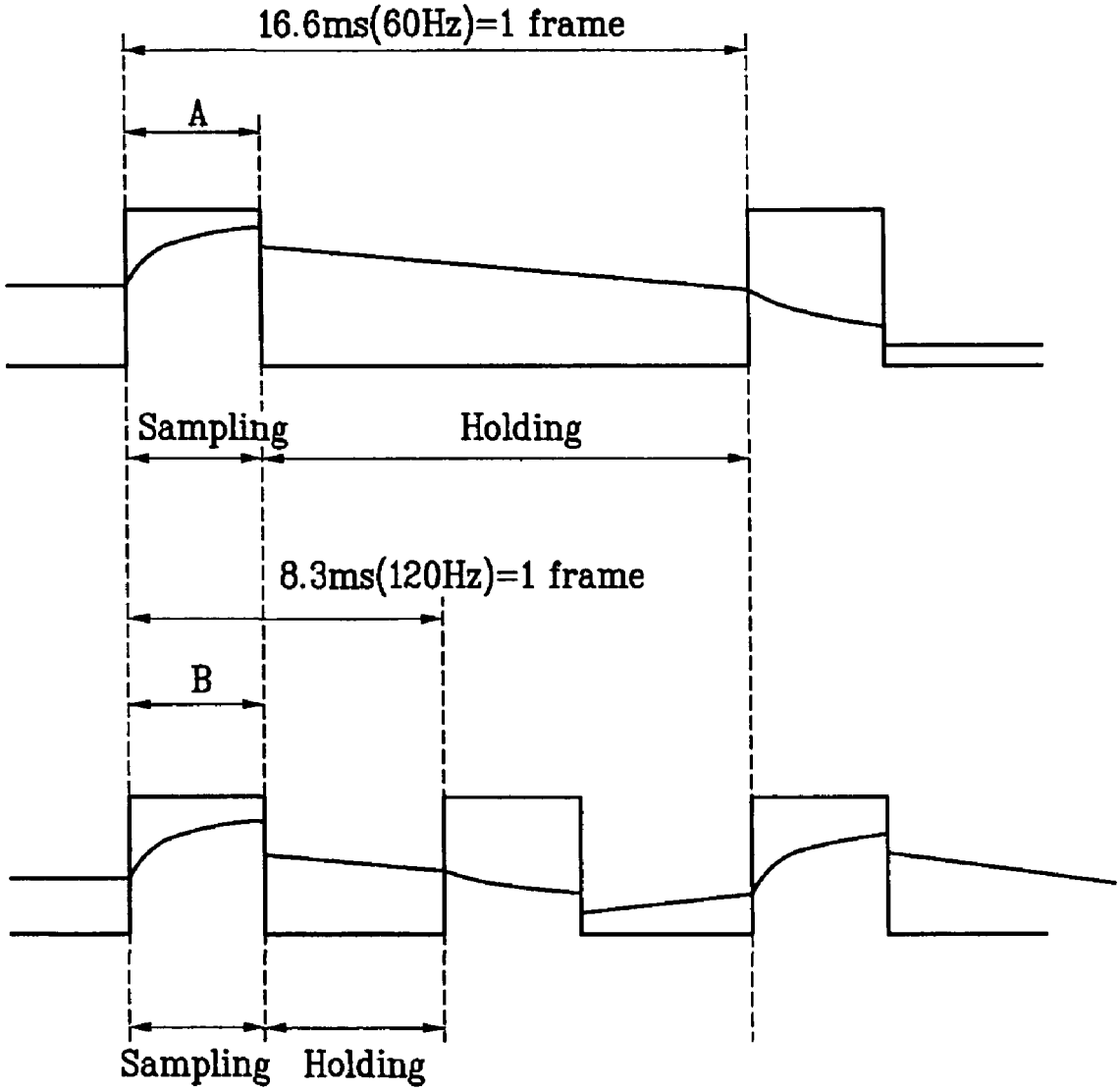
FIG. 9 is a graph showing a sampling and holding time of a LCD device in one embodiment, compared with the 60 Hz operation of the related art.

FIG. 9 is a graph showing a sampling and holding time of a liquid crystal display (LCD) device in one embodiment. For comparison, the 60 Hz operation mode graph of the related art is shown as an upper graph in FIG. 9. As illustrated in FIG. 9, the LCD device of this embodiment operates at a high speed of 120 Hz as shown in the lower graph. The LCD device may obtain a time for adequately charging a data voltage from a data line on a pixel electrode because it has the same sampling time as that of the 60 Hz operation mode, as shown in FIG. 9.

The LCD device operates at a high speed of 120 Hz, and one frame has a frame period of 8.3 ms (=1/120 s). The sampling time is twice as much as that of the high-speed operation mode of the related art, and the holding time is relatively shortened.

For example, a liquid crystal panel having an XGA (1 024×768) resolution has 768 gate lines. In a high-speed operation (120 Hz) of the related art, when a gate high signal is applied independently to each gate line, the gate on time (application time of gate high voltage) is 10.8 μs as noted above. In this LCD device, the gate on time for each gate line is extended to the level of 60 Hz operation. Thus, the application time of the gate high signal (gate on signal) to each gate line becomes 21.7 μs.

Figure 10:
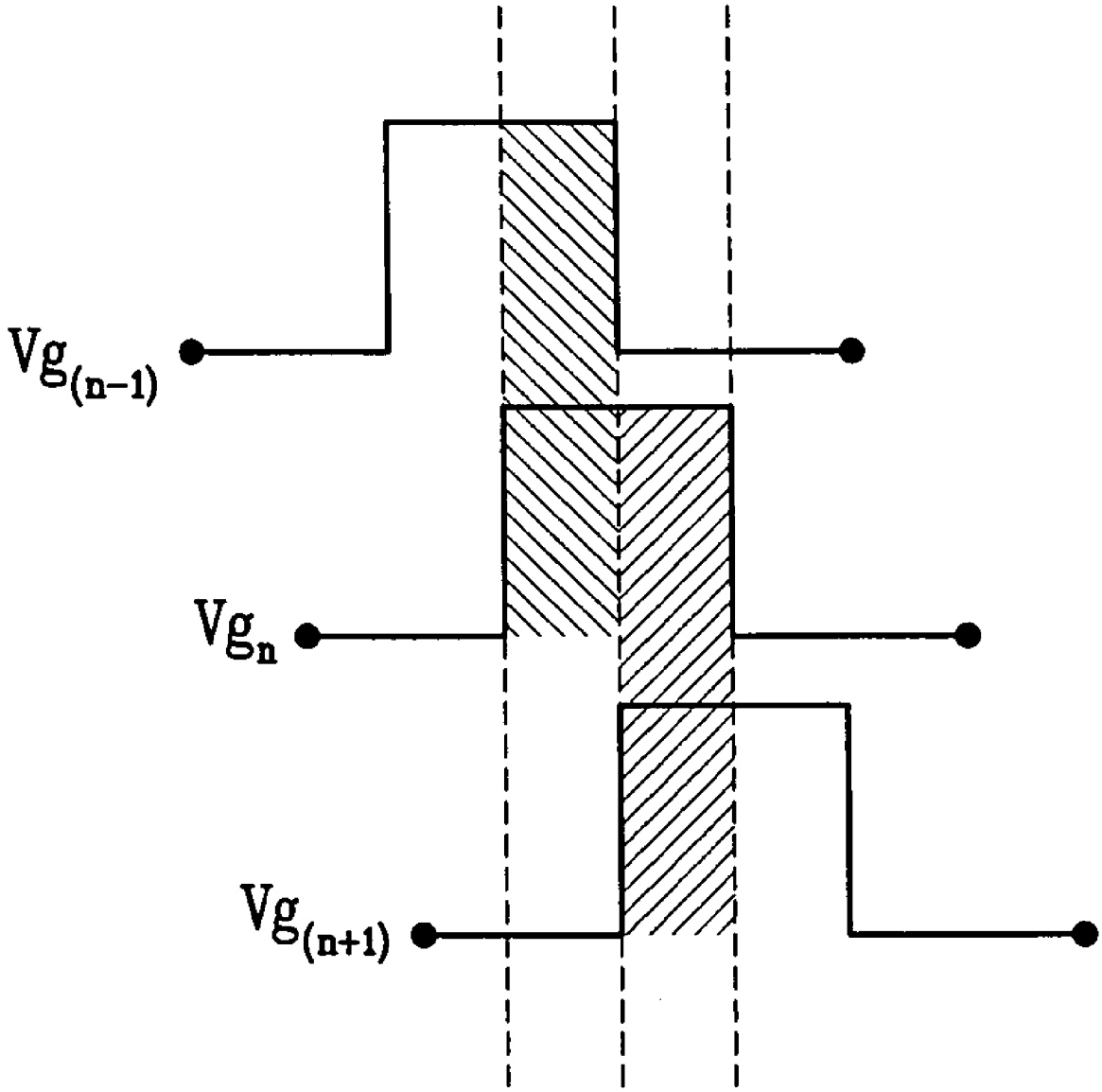
FIG. 10 shows an overlap of signals applied to gate lines in the LCD device.

FIG. 10 shows overlap of signals applied to gate lines in the LCD device. For example, in the case of XGA (1024×768) resolution, 8.3 ms (=1/120 sec) for one frame is required for the high-speed operation (120 Hz). As illustrated in FIG. 10, the LCD device has a gate on time of 21.7 μs to provide a sufficient charging time to the pixel electrode associated with each gate line. Thus, the gate on time is two times as much as 10.8 μs (=8.3 ms/768), which corresponds to the gate on time of the high-speed operation of the related art. Accordingly, when 768 gate lines are turned on sequentially within one frame, an overlap period of gate on times between neighboring gate lines is required to turn on all the 768 gate lines within the total time of 8.3 ms (within one frame).

The average overlapped time between the neighboring lines is about half (½) period of the gate on time, i.e., 10.8 μs (=21.7 μs/2). The gate on time is extended twice, as compared with the high-speed operation of the related art. Thus, if the overlap period between neighboring gate lines is set at the half period of each gate on time, the gate lines placed on the panel may be sequentially turned on during a period of one frame. Therefore, in the LCD device, the gate on time (sampling time) is adequately secured so that the data voltage may be charged on the pixel electrode.

In the above overlap between gate lines, when the $n^{th}$ gate line is turned on (application of $Vg_n$) in the first half gate on time, the gate line is turned on simultaneously with the $(n-1)^{th}$ gate line (application of $Vg_{(n-1)}$), and in the second half gate on time, the gate line is turned on simultaneously with the $(n+1)^{th}$ gate line (application of $Vg_{(n+1)}$).

When a gate on signal (gate high signal) is applied to the gate lines, it applies two neighboring gate lines. Unless the pixel structure is adjusted, it may occur that in the first half gate on time, a data voltage applied to a thin film transistor (TFT) associated with the $(n-1)^{th}$ gate line is applied to a TFT associated with the $n^{th}$ gate line, and in the second half gate on time, a data voltage applied to the TFT associated with the $n^{th}$ gate line is applied to a TFT associated with the $(n+1)^{th}$ gate line. In the overlap period of a gate high signal (the overlap period between $Vg_n$ and $Vg_{(n-1)}$ or the overlap period between $Vg_n$ and $Vg_{(n+1)}$), if a data signal is applied simultaneously to TFTs associated with longitudinally neighboring gate lines, the pixel electrode may fail to charge an adequate data voltage. In this embodiment, the data signal may be applied to the TFTs at a different timing as will be described in conjunction with FIGS. 11 and 12 below.

Figure 11:
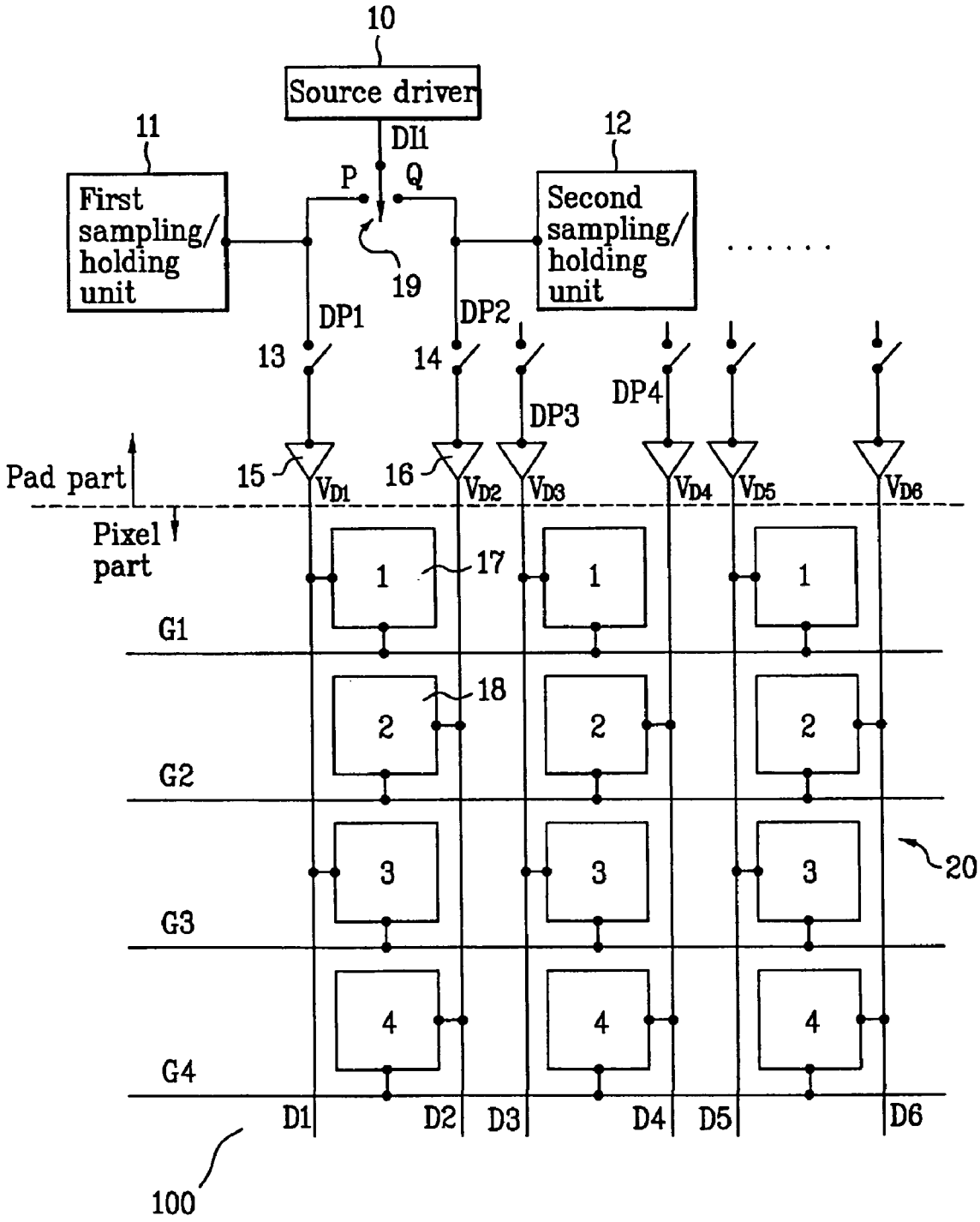
FIG. 11 illustrates configuration of a source driver and a liquid crystal panel in the LCD device.
Figure 12:
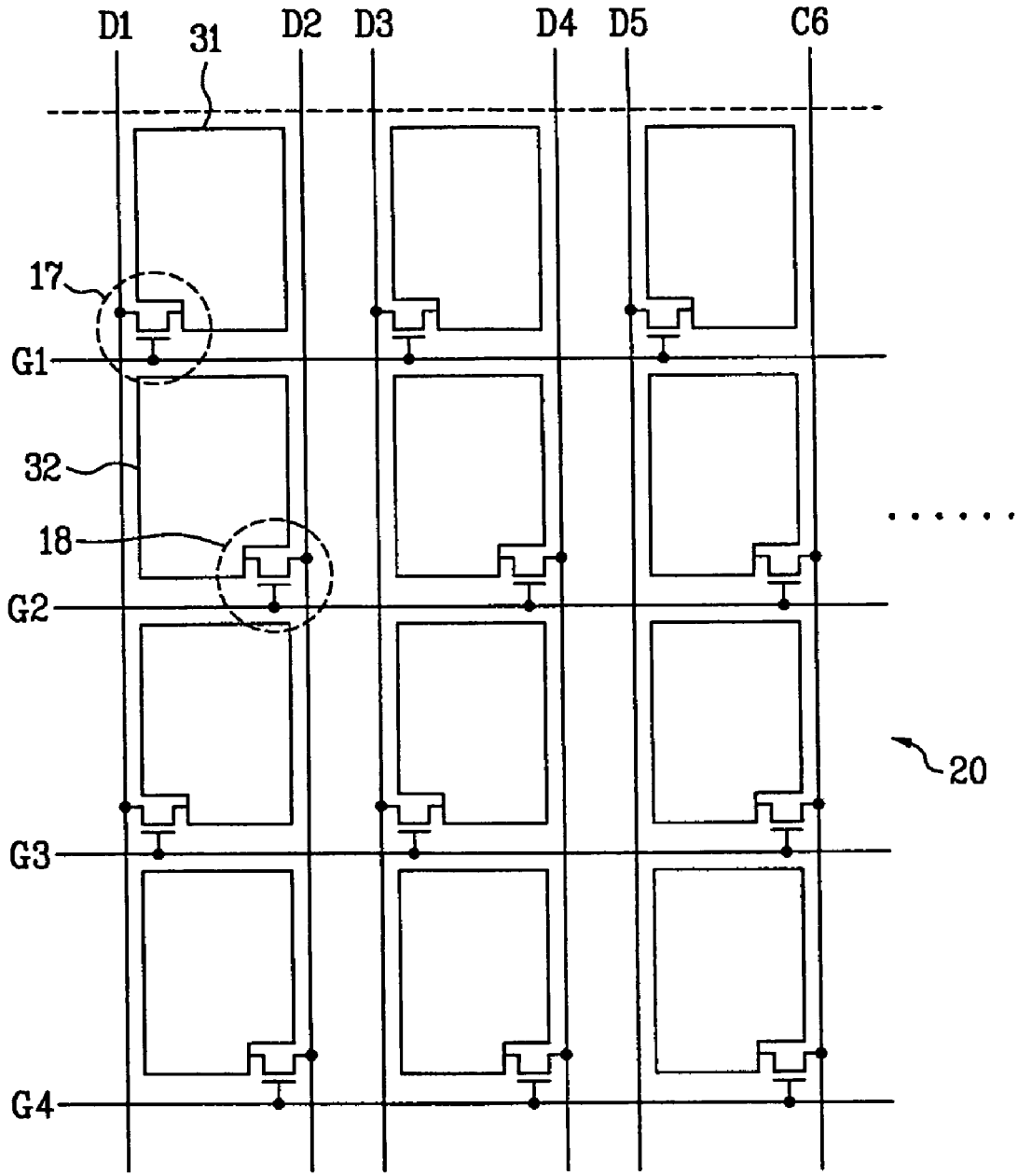
FIG. 12 is a circuit diagram of a pixel part in the LCD device.

FIG. 11 illustrates the connection configuration of the source driver and the liquid crystal panel in an LCD device 100. FIG. 12 is a circuit diagram of a pixel part 20 in the LCD device 100.

As shown in FIG. 11, in the LCD device 100, an output terminal of a source driver 10 outputs a data voltage. The output terminal of the source driver 10 is switched between two points P and Q. The output terminal is connected to a pair of data lines, i.e., to a first data line (left data line) and a second data line (right data line), respectively. An odd data voltage and even data voltage are output from the same output terminal of the source driver 10 and are applied to the first data line D1, D3, D5, D(2N−1) and the second data line D2, D4, D6, . . . , D2N, respectively. At this time, the data voltage from the output terminal is provided to first and second sampling/holding units 11 and 12, which in turn provides the data voltage to each pixel area in an adequate and stable manner. Switches 19, 13 and 14 may select and apply the data voltage from the source driver 10.

The LCD device 100 comprises a liquid crystal panel including the pixel part 20 and a pad part surrounding the pixel part. The LCD device 100 also comprises a gate driver (not shown) and the source driver 10 connected to the pad part of the liquid crystal panel. The pixel part 20 includes an array composed of a plurality of gate lines G1, G2, G3, . . . , and a plurality of pairs of data lines D1, D2, D3, D4, . . . ,.

Each output terminal DI1, . . . , DIN of the source driver 10 is connected to a first sampling/holding unit 11 and a second sampling/holding unit 12. The units 11 and 12 store a data signal from the output terminal DI1, . . . , DIN and transmit the stored data signal to a selected section. A first switch 19 transmits the data signal from the output terminal DI1, . . . , DIN selectively to the first sampling/holding unit 11 and the second sampling/holding unit 12. A second switch 13 applies the data signal stored in the first sampling/holding unit 11 selectively to a first data line D1. A third switch 14 applies the data signal stored in the second sampling/holding unit 12 selectively to a second data line D2. A first buffer 15 and a second buffer 16 are connected to the second switch 13 and the third switch 14 and apply the data signal to the first and second data lines D1 and D2 in a stable way.

The data signal is applied to a pixel electrode of each pixel area placed between the first and second data lines D1 and D2. The odd signal and the even signal from the source driver 10 alternately apply in synchronization with a gate high signal (Vgn) to a gate line associated with each pixel electrode. At this time, the first and second sampling/holding units 11 and 12 store the odd and even data signals and output them to the data lines. In other embodiment, the source driver 10 may include the first and second sampling/holding units 11 and 12, the first to third switches 19, 13 and 14, and the first and second buffers 15 and 16.

Although not illustrated, the output terminal of the gate driver is connected to the plurality of gate lines G1, G2, . . . , GM. Although only one output terminal DI1 of the source driver 10 is shown in FIG. 11, the other output terminals DI2, . . . , DIN of the source driver 10 may be connected to data lines in the same manner as the output terminal DI1 is.

The gate driver applies a gate high signal to each gate line at 120 Hz, as shown in FIG. 9. The gate high signal is applied, in sequence, to each gate line G1, G2, G3, . . . , GM, in such a way that a half period of the gate on time (gate high signal application time) is overlapped between neighboring gate lines. In the LCD device 100, the gate driver operates to secure a sampling time (charging time) twice as much as the operating speed of the gate driver for each gate line G1, G2, G3, . . . , GM. The data signal applied to each data line is adequately charged to the level of a gray scale voltage in a corresponding pixel electrode (for example, pixel electrode 31 or 32 in FIG. 12).

In FIG. 12, the neighboring pixel electrodes 31 and 32 are connected to the data lines D1 and D2 respectively, which are driven at different time points. The data signals may be applied to the pixel electrodes 31 and 32 in a stable way without interference with each other.

As shown in FIG. 12, in the liquid crystal panel of the LCD device 100, a pixel area (1 to 4 of FIG. 11) is defined between the first data line D1, D3, D5, . . . , D(2N−1), the second data line D2, D4, D6, . . . , D2N and the gate line G1, G2, . . . , GM. In addition, a pixel electrode 31 or 32 is formed in each pixel area 1 to 4, a first thin film transistor 17 is formed at the intersection of each odd gate line G1, G3, . . . and the first data line D1, and a second thin film transistor 18 is formed at the intersection of each even gate line G2, G4, . . . and the second data line D2.

The pixel electrode 31 connected with the first thin film transistor 17 receives a data signal $V_{D1}$ from the first data line D1. The pixel electrode 32 connected to the second thin film transistor 18 receives a data signal $V_{D2}$ from the second data line D2. Here, the data signals supplied to the first and second data lines D1 and D2 are an odd signal and an even signal respectively, which are charged in different polarities when applied to the corresponding pixel electrodes. In this case, the data signals are applied to the first and second data lines D1 and D2 with a desired time difference (½ of the gate on time). At this time, the odd and even data voltages are stored and retained in the first and second sampling/holding units 11 and 12, and then applied to the pixel electrodes during the gate high signal period of the corresponding gate lines. As a result, data voltage values are adequately charged to drive the corresponding pixel electrodes.

In the LCD device 100, the signals from the source driver 10 are applied to a pair of data lines, i.e., first and second data lines D1 and D2 through the switching operations of the second and third switches 13 and 14. At this time, the data signal applied to the second data line D2 is delayed as long as the half period of the gate on time relative to the data signal applied to the first data line D1. These signals are applied to the pixel electrode in synchronization with a rising edge of the gate high signal.

Referring back to FIG. 11, in the LCD device 100, an output value from each output terminal of the source driver 10 is bisected, and the number of data lines is made to be twice as much as that of the output terminals in the same mode. For example, a LCD device of the related art having an XGA (1024×768) resolution has 768 gate lines and 3072 data lines (=1024×3: one pixel is formed of R, G and B sub pixels). The LCD device 100 of this embodiment, however, has 768 gate lines and 7144 data lines (=3072×2).

In the LCD device 100, the gate high signal $Vg_n$ is applied to the gate lines, in such a manner that each gate on time of the previous gate line and the next gate line is overlapped with the current gate line during the first half period and the second half period, respectively. When the signal is applied to a gate line, an odd-mode data signal is applied to the first data line D1 through the second switch 13. After a half period of the gate on time, an even-mode data signal is applied to the second data line D2 through the third switch 14. For convenience of explanation, the first data line D1 and the output terminal DI1 are described. However, the LCD device 100 includes more first data lines and output terminals.

The first thin film transistors 17 are formed between the first data lines D1 and the odd gate lines G1 and the second thin film transistors 18 are formed between the second data lines D2 and the even gate lines G2. Even if the drive voltage is applied so as to be overlapped between neighboring gate lines G1, G2, . . . , GM during a half period of the gate on time, the thin film transistors 17 and 18 on the adjacent gate lines G1 and G2 are driven at different time points. In addition, the data signals are applied from the sampling/holding units 11 and 12, and not directly from the output terminal of the source driver 10. The data signals may be input in a stable and constant manner. It is possible to prevent degradations in pixel voltage and image quality which may result from the gate on time overlapping between neighboring gate lines. The first thin film transistors 17 and the second thin film transistors 18 may properly receive gate high signals in sequence, as if they operate at 60 Hz.

In the LCD device 100, even if the gate on time period is partially overlapped between neighboring gate lines, the odd-mode data signal and the even-mode data signal stored in the first and second sampling/holding units 11 and 12 are applied respectively to the first and second data lines. In synchronization with the rising edge of a gate high signal, a data signal is output during the gate high signal period. During the high signal overlap period between gate lines, an adequate sampling period is achieved such that a data voltage may be charged sufficiently on each individual pixel electrode. A data voltage having a stable gray scale value may be applied.

For the frame period of 8.3 ms (=1/120 sec) of the high-speed operation at 120 Hz, a half period of the gate high signal is overlapped between the neighboring gate lines. Accordingly, the gate on time of each gate line corresponds to 21.7 μs (10.8 μs is overlapped between adjacent gate lines), but the data signal is applied so as not to overlap between neighboring gate lines. Therefore, an adequate gate on time is secured from the source driver such that the data voltage may be sufficiently charged and avoid the motion blurring phenomenon. The LCD device 100 is configured to drive the source driver 10 such that the odd-mode data signal and the even-mode data signal alternate at a period of one half of the gate high signal.

Figure 13:
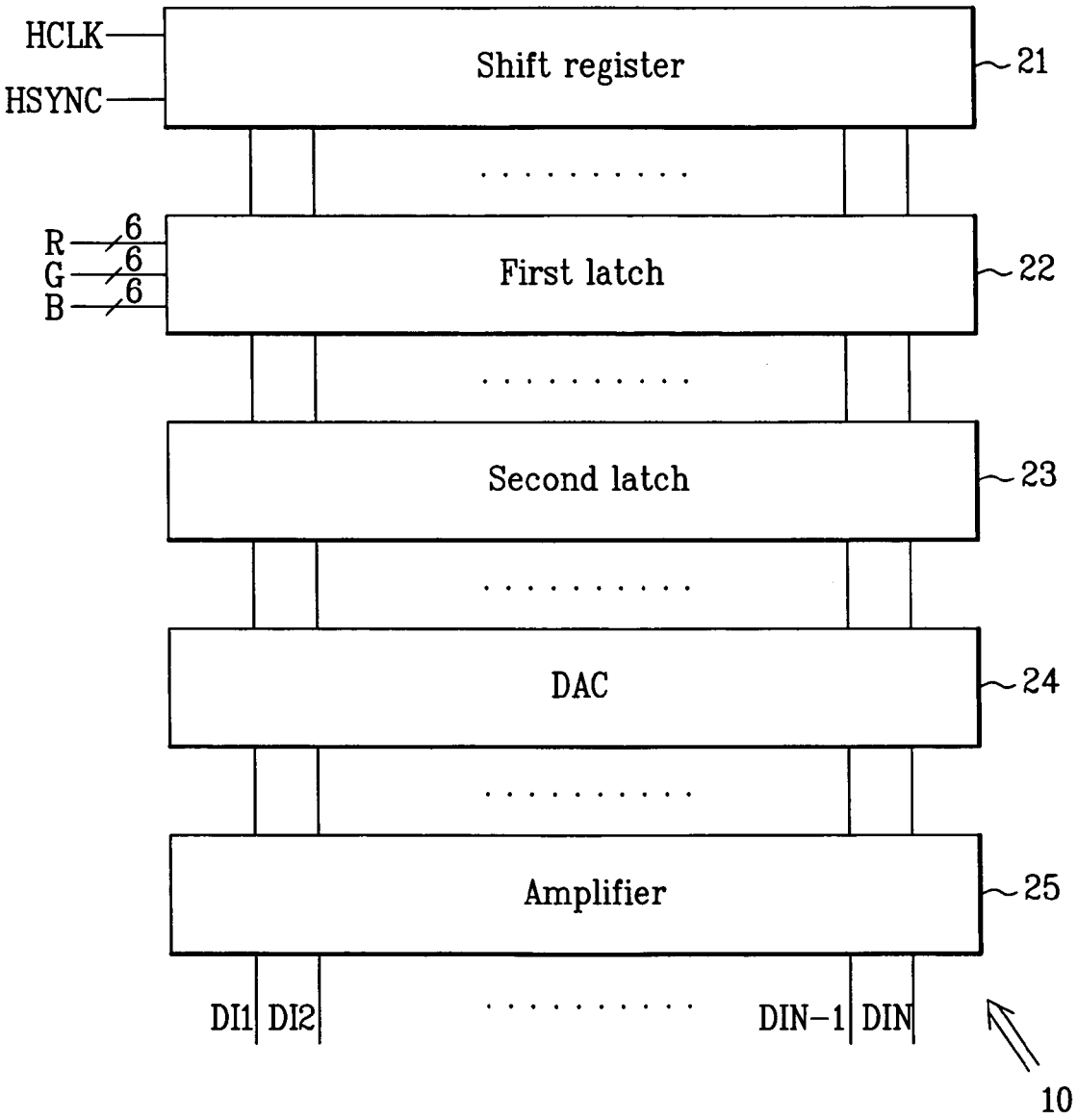
FIG. 13 is a schematic diagram showing the internal configuration of the source driver in FIG. 11.

FIG. 13 is a schematic diagram showing the internal configuration of the source driver 10 of FIG. 11. As shown in FIG. 13, the source driver 10 includes a shift resistor 21, a first latch 22, a second latch 23, a digital-to-analog converter (DAC) 24 and an amplifier 25.

An image signal are supplied from the system to the first latch 22 of the source driver 10 and includes a 6-bit data signal each for R, G and B. For example, where the LCD device has an XGA resolution, the number of data lines in the liquid crystal panel is 1024×3×2, and the number of outputs of the source driver 10 is 1024×3. The number of outputs of the source driver 10 corresponds to one half of data lines provided in the liquid crystal panel. In FIG. 13, 'HCLK' is a source pulse clock signal and 'HSYNC' is a horizontal synchronous signal, both of which are applied from an external timing controller.

The operation of the source driver 10 with the above construction will be described below. The shift register 21 shifts the horizontal synchronous signal HSYNC in response to the source pulse clock signal HCLK and outputs the shifted signal as a latch clock to the first latch 22.

The first latch 22 samples and latches digital R, G and B data for each output terminal DI1, DI2, . . . , DIN in response to the latch clock output from the shift register 21. The second latch 23 receives and latches the R, G and B data latched by the first latch 22 simultaneously in response to a load signal LD.

The DAC 24 converts the digital R, G and B data latched by the second latch 23 into analog R, G and B data. The amplifier 25 operates to amplify the analog R, G and B data from the DAC 24 by a predetermined level and outputs the amplified data to each of the output terminals DI1, D12, . . . , DIN of the source driver of the panel.

The LCD device described above has various advantages and effects as follows. The liquid crystal panel may operate at a high speed, thereby significantly reducing the motion blurring phenomenon and improving the image quality.

The liquid crystal panel operates at a high speed and the gate on time is overlapped in a half period between neighboring gate lines. An adequate sampling time may be obtained for each gate line so as to charge a data voltage sufficiently on the pixel electrode. Therefore, brightness degradation may be prevented in the LCD device supplying a signal in a holding manner.

Although the liquid crystal panel operates internally at a high speed, the source driver is driven in a common way. Instead, each output terminal of the source driver is bisected and the bisected output terminal is connected to the sampling/holding unit. An adequate charging time may be provided to pixel electrodes when the data voltage is applied to the pixel electrodes. Thus, a high-speed operation may be achieved without newly constructing a high-cost source driver.

Each output terminal of the source driver is bisected such that the same data voltage is applied to neighboring data lines separately in an odd mode and an even mode at different time points. Thus, each pixel electrode corresponding to the data line is charged and driven separately at different time points so that a normal data voltage may be applied to each pixel electrode. As a result, image degradation and dim phenomenon may be prevented.

It will be apparent to those skilled in the art that various modifications and variations can be made without departing from the spirit or scope of the invention. Thus, it is intended that the invention covers the modifications and variations provided they come within the scope of the appended claims and their equivalents.

What is claimed is:

1. A liquid crystal display device comprising:

a first and second substrate facing each other;

a plurality of pairs of data lines formed in a display section of the first substrate, each pair of data lines including first and second data lines adjacent to each other wherein there is no pixel area between each different pair of data lines;

a plurality of gate lines formed on the first substrate and intersecting the plurality of pairs of data lines, the gate lines defining pixel areas between the first and second data lines;

a plurality of pixel electrodes formed in the pixel areas;

a gate driver for applying a gate signal to the gate lines, wherein the gate driver applies a gate high signal such that during a first half period, the gate high signal is applied to a previous gate line and a current gate line, and during a second half period, the gate high signal applies to the current gate line and a subsequent gate line, and the previous gate line and the subsequent gate line are disposed longitudinally adjacent the current gate line;

a source driver for outputting the same data voltage charged in different polarities to the first and second data lines of each pair of data lines, wherein the application of the data signal to the second data line is delayed by a half-period of the gate high signal after the data signal is applied to the first data line;

a first thin film transistor in a pixel area between a corresponding gate line and the first data line;

a second thin film transistor in a pixel area between the corresponding gate line and the second data line; and a latch circuit for storing the data signal output from an output terminal of the source driver, the latch circuit transmitting a relevant data signal to a first pixel electrode and a second pixel electrode formed between the first and second data lines of each pair of data lines, wherein a data voltage is sufficiently charged on each pixel electrode when the gate driver is operated at a high speed and application time of the gate high signal to each gate line is twice as much as a value to divide one frame into the number of the gate lines.

2. The liquid crystal display device as set forth in claim 1, wherein the relevant data signal transmitted to each pixel electrode comprises one of an odd signal and an even signal, and the odd signal and the even signal are alternately applied from the source driver in synchronization with a gate high signal applied to a gate line associated with each pixel electrode.

3. The liquid crystal display device as set forth in claim 2, wherein the odd signal is applied from the corresponding output terminal of the source driver to the first data line and the even signal is applied from the corresponding output terminal of the source driver to the second data line.

4. The liquid crystal display device as set forth in claim 2, wherein the first pixel electrode receives the relevant data signal from the first data line, and the second pixel electrode receives the relevant data signal from the second data line.

5. The liquid crystal display device as set forth in claim 1, wherein the latch circuit comprises:

a first sampling/holding unit and a second sampling/holding unit for storing the data signal from the corresponding output terminal of the source driver and transmitting the stored data signal to a selected data line.

6. The liquid crystal display device as set forth in claim 5, wherein the latch circuit further comprises:

a first switch for transmitting the data signal from the source driver selectively to the first sampling/holding unit and the second sampling/holding unit;

a second switch for applying the data signal stored in the first sampling/holding unit selectively to the first data line; and a third switch for applying the data signal stored in the first sampling/holding unit selectively to the second data line.

7. The liquid crystal display device as set forth in claim 1, wherein the latch circuit is formed on the first substrate.

8. The liquid crystal display device as set forth in claim 1, wherein the latch circuit is built in the source driver.

9. A liquid crystal display device comprising:

a first and second substrate facing each other;

a plurality of pairs of data lines formed on the first substrate, each pair of data lines including first and second data lines adjacent to each other wherein there is no pixel area between each different pair of data lines;

a plurality of gate lines formed on the first substrate to intersect the data lines, the gate lines defining pixel areas between the first and second data lines;

a plurality of pixel electrodes formed in the pixel areas;

a plurality of first thin film transistors formed at an intersection of the first data line and an odd gate line and electrically connected to a pixel electrode associated with the odd gate line;

a plurality of second thin film transistors formed at an intersection of the second data line and an even gate line and electrically connected to a pixel electrode associated with the even gate line;

a gate driver for applying a gate signal to the gate lines;

a source driver for outputting the same data voltage charged in different polarities to the first and second data lines of each pair of data lines, wherein the data signal of each pair of data lines from the source driver is applied to the first data line and then applied to the second data line after the delay of the half period of the gate high signal; and a first sampling/holding unit and a second sampling/holding unit for storing a data signal output from the source driver and transmitting the stored data signal to the first and second data lines, wherein the gate driver applies a gate high signal to a current gate line and a previous gate line during a first half period of the gate high signal, and the gate driver applies the gate high signal to the current gate line and a subsequent gate line during a second half period of the gate high signal, and the current gate line is disposed longitudinally adjacent the previous gate line and the subsequent gate line and wherein the application of the data signal to the second data line is delayed by one half-period of the gate high signal after the data signal is applied to the first data line, wherein a data voltage is sufficiently charged on each pixel electrode when the gate driver is operated at a high speed and application time of the gate high signal to each gate line is twice as much as a value to divide one frame into the number of the gate lines.

10. The liquid crystal display device as set forth in claim 9, wherein the data signal is transmitted to a pixel electrode in the pixel area and comprises one of an odd signal and an even signal, and the odd signal and the even signal are alternately applied from the corresponding output terminal of the source driver in synchronization with a gate high signal applied to a gate line associated with each pixel electrode.

11. The liquid crystal display device as set forth in claim 10, wherein the odd signal is applied from the corresponding output terminal of the source driver to the first data line and the even signal is applied from the corresponding output terminal of the source driver to the second data line.

12. The liquid crystal display device as set forth in claim 9, wherein the plurality of pixel electrodes comprises an odd pixel electrode and an even pixel electrode, and the odd pixel electrode receives the data signal from the first data line, and the even pixel electrode receives the data signal from the second data line.

13. The liquid crystal display device as set forth in claim 9, wherein the first and second sampling/holding units are formed on the first substrate.

14. The liquid crystal display device as set forth in claim 9, wherein the first and second sampling/holding units are built in the source driver.

15. A driving method of a liquid crystal display device, comprising:

supplying a gate high signal from a gate driver to neighboring gate lines wherein the gate high signal is overlapping at the neighboring gate lines during a half period of the gate high signal;

applying data voltages from a source driver to a plurality of pairs of data lines, each pair of data lines including first and second data lines adjacent to each other wherein there is no pixel area between each different pair of data lines and wherein the data voltage of each pair of data lines from the source driver is applied to the first data line and then applied in opposite polarity to the second data line after the delay of the half period of the gate high signal, wherein the source driver is outputting the same data voltage in different polarities to the first and second data lines of each pair of data lines;

charging a pixel electrode in the pixel area associated with one of the first data line and the second data line during an extended gate on time of the gate high signal, wherein the data voltage sufficiently charges on each pixel electrode when the gate driver is operated at a high speed and application time of the gate high signal to each gate line is twice as much as a value to divide one frame into the number of the gate lines.

16. The driving method as set forth in claim 15, wherein supplying the gate high signal comprises:

supplying the gate high signal to a previous gate line and a current gate line during a first half period of the gate high signal; and supplying the gate high signal to the current gate line and a next gate line during a second half period of the gate high signal.

17. The driving method as set forth in claim 15, further comprising:

providing a first output signal from a source driver to the first data line; and providing a second output signal from the source driver to the second data line at a different timing.

18. The driving method as set forth in claim 17, further comprising:

providing an odd signal to the first data line; and providing an even signal to the second data line, and wherein the odd signal and the even signal are provided in synchronization with the gate high signal.

19. The driving method as set forth in claim 15, further comprising activating a switch to select one of the first data line and the second data line to apply the data signal.

20. The driving method as set forth in claim 15, further comprising:

storing the data signal in a sample and holding unit; and selectively transmitting the stored data to the first data line and the second data line.

21. The driving method as set forth in claim 15, further comprising:

bisecting an data signal output from the source driver into first and second data voltage outputs;

applying a first data voltage to the first data line;

applying a second data voltage to the second data line at a different timing.

22. The driving method as set forth in claim 15, wherein supplying the gate high signal comprises supplying the gate high signal for a period of 21.7 μs to each gate line.

23. The driving method as set forth in claim 22, further comprising operating the liquid crystal display device in a high speed operation mode having an operating frequency of 120 Hz.

* * * * *